US009799478B2

(12) United States Patent
Kato et al.

(10) Patent No.: US 9,799,478 B2
(45) Date of Patent: Oct. 24, 2017

(54) FUSE UNIT

(71) Applicant: YAZAKI CORPORATION, Tokyo (JP)

(72) Inventors: Motofumi Kato, Shizuoka (JP); Tatsuya Aoki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/772,270

(22) PCT Filed: Mar. 28, 2014

(86) PCT No.: PCT/JP2014/059367

§ 371 (c)(1),
(2) Date: Sep. 2, 2015

(87) PCT Pub. No.: WO2014/163023

PCT Pub. Date: Oct. 9, 2014

(65) Prior Publication Data

US 2016/0013003 A1 Jan. 14, 2016

(30) Foreign Application Priority Data

Apr. 1, 2013 (JP) ..... 2013-076061

(51) Int. Cl.
*H01H 85/20* (2006.01)
*H01H 85/12* (2006.01)
*H01H 85/22* (2006.01)

(52) U.S. Cl.
CPC ..... *H01H 85/205* (2013.01); *H01H 85/12* (2013.01); *H01H 85/202* (2013.01);
(Continued)

(58) Field of Classification Search
CPC .. H01H 85/205; H01H 85/202; H01H 85/203; H01H 85/2045; H01H 85/22;
(Continued)

(56) References Cited

U.S. PATENT DOCUMENTS 5,438,310 A * 8/1995 Ikari ..... H01H 85/20 337/186
6,294,978 B1 * 9/2001 Endo ..... H01H 85/044 337/159

(Continued)

FOREIGN PATENT DOCUMENTS

CN 102754179 A 10/2012
JP 2007-87823 A 4/2007

(Continued)

OTHER PUBLICATIONS

International Search Report for PCT/JP2014/059367 dated Jun. 10, 2014.

(Continued)

*Primary Examiner* — Jerry Wu
*Assistant Examiner* — Stephen Sul
(74) *Attorney, Agent, or Firm* — Kenealy Vaidya LLP

(57) ABSTRACT

A fusible link having a high-rated terminal group and a low-rated fuse box are provided. The low-rated fuse box has a power-source-side terminal connected to an auxiliary terminal of the fusible link, a load-side connection terminal to be connected to a load side, a holder configured to hold the power-source-side terminal and the load-side connection terminals, and a low-current fuse configured to electrically connect, when attached to the holder in a detachable manner, the power-source-side terminal and the load-side connection terminals to each other.

3 Claims, 3 Drawing Sheets

(52) U.S. Cl.
CPC ..... *H01H 85/203* (2013.01); *H01H 85/2045* (2013.01); *H01H 85/22* (2013.01); *H01H 2085/208* (2013.01)

(58) Field of Classification Search
CPC ..... H01H 85/12; H01H 2085/208; H01H 2085/0555; H01H 2085/206; H01H 2085/2075; H01H 2085/209; H01H 85/2015; H01H 85/204; H01H 2085/2055; H01H 2085/2085; H05K 2201/10325; H05K 2201/10333; H01R 13/688
USPC ..... 337/188, 191, 197, 209, 186, 208
See application file for complete search history.

(56) References Cited

U.S. PATENT DOCUMENTS

2002/0163416 A1 11/2002 Matsumura
2011/0306243 A1* 12/2011 Shiraki ..... H01R 11/287 439/620.29
2012/0188050 A1* 7/2012 Nohara ..... H01H 85/201 337/142

FOREIGN PATENT DOCUMENTS

JP 2010-245001 A 10/2010
JP 2012-113939 A 6/2012
JP 2012-155995 A 8/2012

OTHER PUBLICATIONS

The English translation of the Written Opinion of the International Search Report for PCT/JP2014/059367 dated Jun. 10, 2014.
Chinese Office Action for the related Chinese Patent Application No. 201480019523.9 dated Oct. 24, 2016.
Chinese Office Action for the related Chinese Patent Application No. 201480019523.9 dated Jun. 9, 2017.
Japanese Office Action for the related Japanese Patent Application No. 2013-076061 dated Feb. 28, 2017.

* cited by examiner

FUSE UNIT

TECHNICAL FIELD

The present invention relates to a fuse unit.

BACKGROUND ART

Generally, a fusible link is disposed between an in-vehicle battery and load-side devices of an automobile. A fusible link has a plurality of branched lines connected to a plurality of loads, and is configured to protect a circuit with fuses having different rated currents for each branched line. The lines from one power-source-side terminal (i.e., an upstream terminal disposed upstream in the current flowing direction) to a plurality of branched load-side connection terminals (downstream terminals disposed downstream in the current flowing direction) via fusible elements each having function of a fuse are provided by a single sheet of busbar formed by pressing in a linked manner.

(a) of FIG. 3 shows an example of an exterior configuration of a conventional fusible link disclosed in Patent Document 1, and (b) of FIG. 3 shows its circuit configuration. The fusible link 101 shown in (a) of FIG. 3 has a busbar 110 forming a wiring circuit and a resin housing 102 insert-molded so as to be integral with the busbar 110. The busbar 110 has an upstream terminal 11 and downstream terminals 12, 13 connected to the upstream terminal 11 via respective fusible elements (fuses) 14, 15 in a linked manner, and press-formed as a single, integral body.

While the fusible elements 14, 15 are not directly shown in (a) of FIG. 3, the fusible elements 14, 15 are disposed in respective windows formed in the resin housing 102. The downstream terminals 12, 13 are provided with stud bolts 12*a*, 13*a* to which load-side connection terminals are to be connected. The resin housing 102 is provided so as to expose the terminals 11-13 and the fusible elements 14, 15 of the busbar 110 and to cover the other portions.

PRIOR ART DOCUMENTS

Patent Documents

Patent Document 1: JP2010-245001A

SUMMARY OF INVENTION

Problem to be Solved by Invention

With fusible links in which fusible elements are integrally provided on a busbar, the rated current values of the respective fusible elements are determined by the conductivity of metal material of the busbar and sizes of the respective fusible elements. Therefore, it cannot provide a combination of fusible elements having largely different rated current values. For example, while a combination of fusible elements 14, 15 of 140 A and 80 A can be provided as shown in (b) of FIG. 3, it is difficult to provide a combination of fusible elements 14, 15 having largely different rated currents of 140 A and 7.5 A as shown in (c) of FIG. 3.

Because of the limitation on the combination of fusible elements as described above, it is difficult, in particular, to add a low-rated line or to change an add-on line. Thus, it could flexibly accommodate needs for addition of lines of various ratings.

The present invention has been made in view of the circumstances described above, and it is an object thereof to provide a fuse unit that can flexibly accommodate a need for addition of a low-rated line to a high-rated fusible link.

Means for Solving the Problem

The above object of the invention is achieved by the following configuration.

(1) A fuse unit including:

a fusible link having a high-rated terminal group and configured as a busbar on which fusible elements defining rated values are integrally formed; and a low-rated fuse box arranged downstream of the fusible link in a current flowing direction, the low-rated fuse box being connected to one terminal of the terminal group of the fusible link in a detachable manner and having a lower rated value than the fusible link, wherein the low-rated fuse box includes a power-source-side terminal connected to the one terminal of the terminal group of the fusible link, at least one load-side connection terminal to be connected to a load side, a holder made of an insulating material and configured to hold the power-source-side terminal and the load-side connection terminal, and a low-current fuse having a smaller rated current value than the fusible elements and configured to electrically connect, when attached to the holder in a detachable manner, the power-source-side terminal and the load-side connection terminal to each other.

(2) The fuse unit according to claim 1, wherein the power-source-side terminal of the low-rated fuse box and the terminal of the fusible link to which the power-source-side terminal is connected in a detachable manner are configured as a male terminal and a female terminal into which the male terminal is fitted.

The fuse unit having the configuration (1) described above has the fusible link and the low-rated fuse box connected to one of the terminals of the fusible link in a detachable manner. Therefore, by selecting and attaching a suitable low-current fuse in the low-rated fuse box, it is possible to promptly and flexibly accommodate a need for an addition of a low-rated line while maintaining the high rating of the fusible link. Further, it is possible to accommodate a need for an addition of a low-rated line using an existing fusible link as it is, so there is no problem of, for example, an extra cost for a die.

According to the fuse unit having the configuration (2) described above, since the power-source-side terminal of the low-rated fuse box and the terminal of the fusible link to which the power-source-side terminal is connected in a detachable manner are configured as male-female fitting terminals, the low-rated fuse box can be attached and detached easily so that it is possible to easily accommodate a need for addition of a low-rated line.

The present invention has been briefly described above. Details of the present invention will apparent by reading through the modes for carrying out the invention (hereinafter, embodiments) described below with reference to the accompanying drawings.

EMBODIMENTS OF INVENTION

Figure 1:
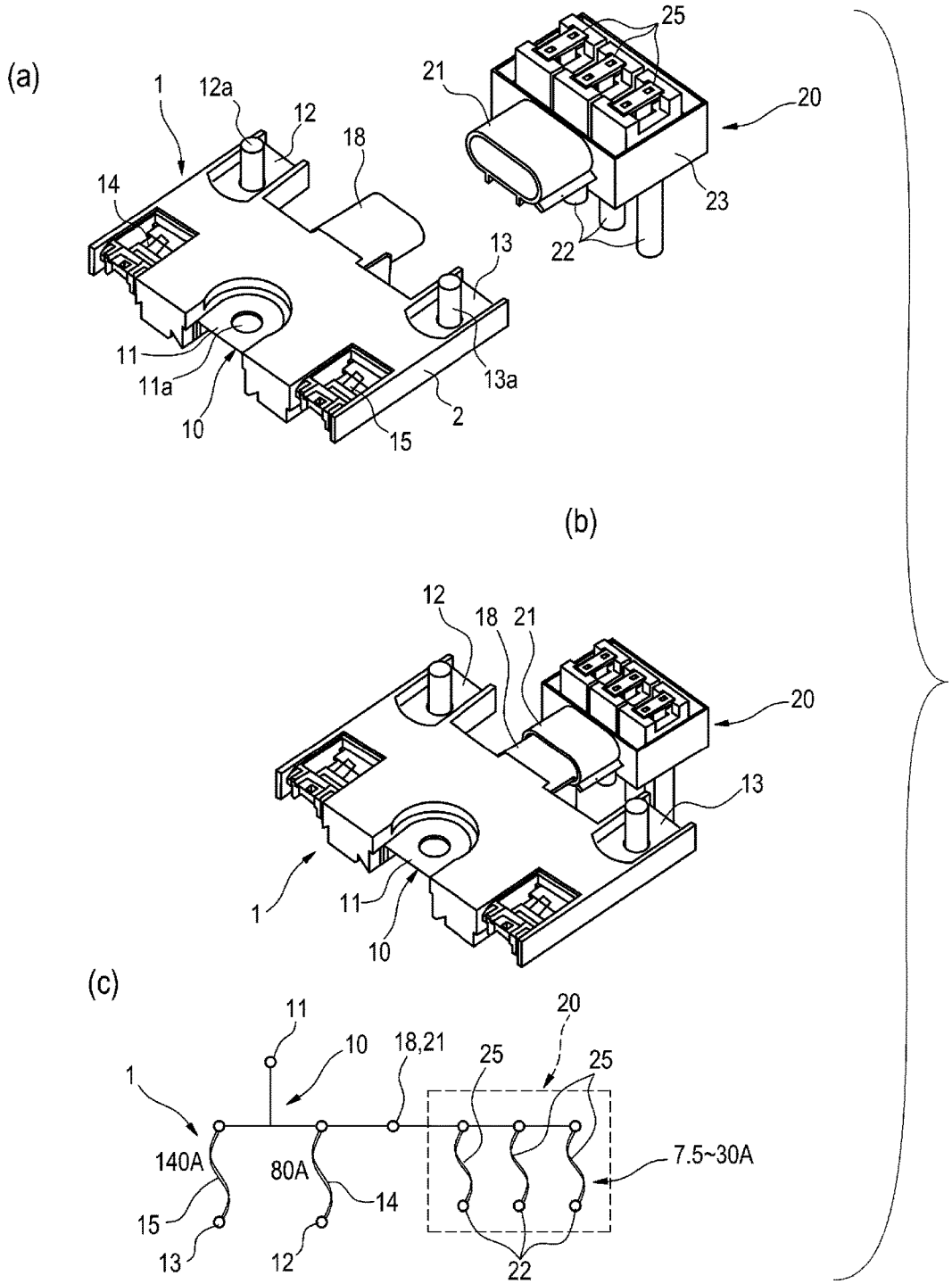
FIG. 1 illustrates a first embodiment of the present invention, (a) of FIG. 1 being a perspective view of a fuse unit according to the first embodiment before attaching a fuse box, (b) of FIG. 1 being a perspective view of the fuse unit after attaching the fuse box, and (c) of FIG. 1 being a schematic diagram of a fuse circuit using the fuse box according to the first embodiment.

Embodiments of the present invention will be hereinafter described with reference to the drawings. FIG. 1 illustrates a first embodiment of the invention. As shown in (a) and (b) of FIG. 1, a fuse unit according to the first embodiment has a fusible link 1 and a low-rated fuse box 20. The fusible link 1 has a resin housing 2 and a high-rated terminal group (will be described later), and is configured as a busbar 10 on which fusible elements 14, 15 defining rated values are integrally formed. The low-rated fuse box 20 is arranged downstream of the fusible link 1 in a current flowing direction. The low-rated fuse box 20 is connected to one terminal of the terminal group of the fusible link 1 in a detachable manner, and has a lower rated value than the fusible link 1.

The busbar 10 of the fusible link 1 has, as the terminal group, an upstream terminal 11 having an attachment hole 11*a* for connection to a battery, two downstream terminals 12, 13 connected to the upstream terminal 11 via respective fusible elements 14, 15 and to be connected to a load side, and an auxiliary terminal 18 electrically connected to the upstream terminal 11 directly. The downstream terminals 12, 13 are provided with stud bolts 12*a*, 13*a* respectively. The auxiliary terminal 18 is configured as a male terminal of male-female fitting terminals for detachable connection of the low-rated fuse box 20.

The low-rated fuse box 20 has a power-source-side terminal 21 to be connected to the auxiliary terminal 18 of the terminal group of the fusible link 1, one or more (three in the illustrated example) load-side connection terminals 22 to be connected to a load side, a holder 23 made of a resin (insulating material) and configured to hold the power-source-side terminal 21 and the load-side connection terminals 22, and low-current fuses 25 configured to electrically connect, when attached to the holder in a detachable manner, the power-source-side terminal 21 and the load-side connection terminals 22 to each other and having much smaller rated current values than the fusible elements 14, 15 of the fusible link 1.

In the above configuration, as shown in (c) of FIG. 1, the rated currents of the fusible elements 14, 15 of the fusible link 1 are set at large values such as 80 A and 140 A. On the other hand, the rated currents of the low-current fuses 25 are set to be much lower than the rated currents of the fusible elements 14, 15, at about 7.5 A to 30 A. The low-current fuses 25 are blade fuses (e.g., low-height fuses) or cartridge-type fuses and ones having different rated values are attached.

The power-source-side terminal 21 is provided so as to project from a side surface of the holder 23 and is configured as a female terminal capable of being fitted with the male auxiliary terminal 18 of the fusible link 1.

Next, a description will be made as to how the fuse unit according to the first embodiment works. When there is a need for an addition of a low-rated fuse line to the high-rated fusible link 1, as shown in (b) of FIG. 1, the low-rated fuse box 20 is attached to the auxiliary terminal 18 of the fusible link 1. In this manner, the low-rating load-side connection terminals 22 can easily be set separately from the high-rating downstream terminals 12, 13 of the fusible link 1. Thus, it is possible to promptly and flexibly accommodate a need for addition of a low-rated line.

In a case where an existing fusible link 1 has the auxiliary terminal 18, it is possible to accommodate a need for addition of a low-rated line using the existing fusible link 1 as it is. Thus, where is no problem of, for example, an extra cost for a die. Further, in the fuse unit according to the first embodiment, the fuse box 20 is connected to the auxiliary terminal 18 which is electrically connected to the upstream terminal 11 (to be connected to a battery) directly, that is, via no fusible elements. Therefore, in the fuse unit according to the first embodiment, the low-rated fuse box 20 can be connected to the fusible link 1 in a branched manner from the upstream terminal 11.

The power-source-side terminal 21 of the low-rated fuse box 20 and the auxiliary terminal 18 of the fusible link 1 are configured as the male-female fitting terminals. Therefore, the low-rated fuse box 20 can be attached and detached easily and hence it is possible to easily accommodate a need for addition of a low-rated line.

Figure 2:
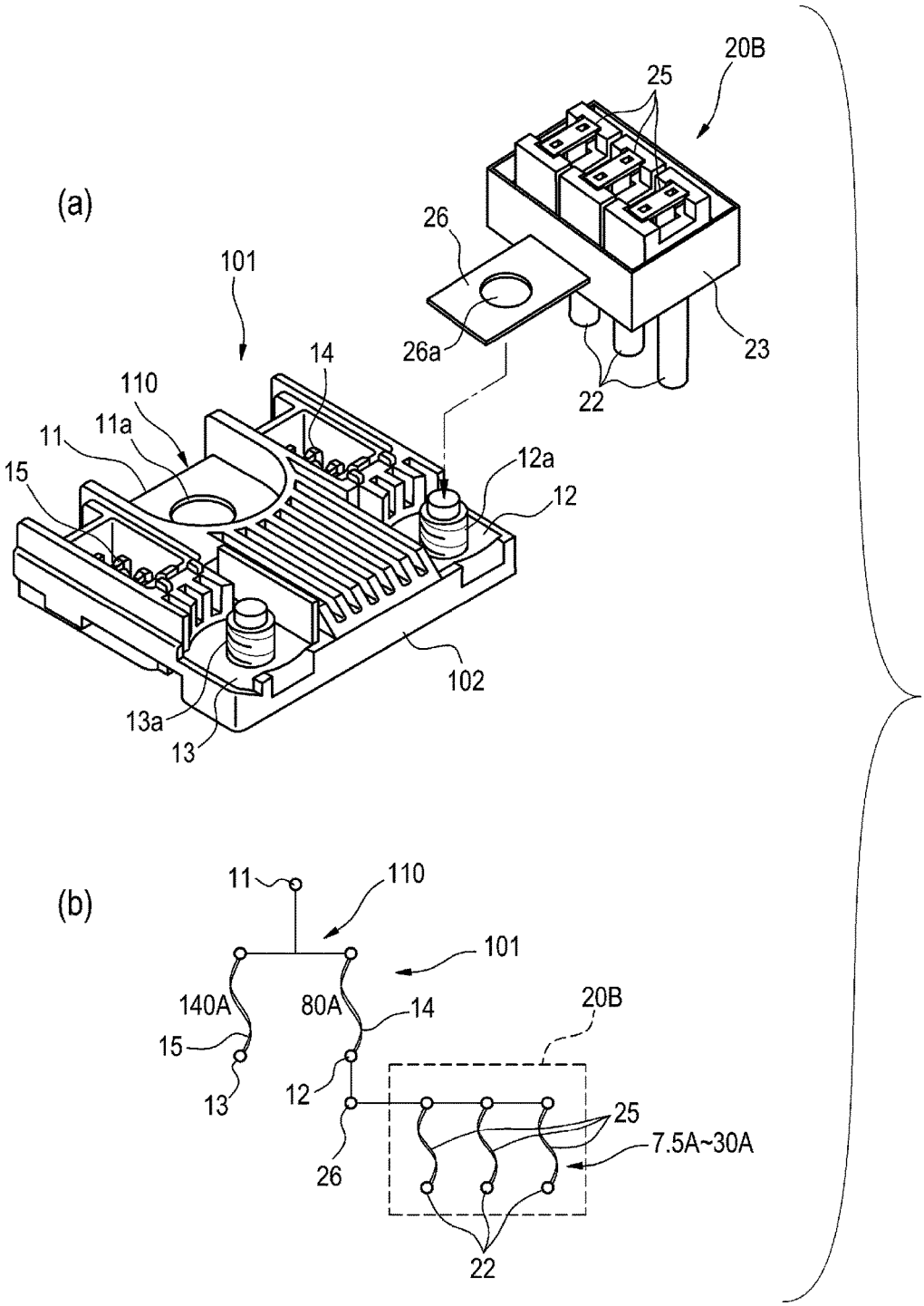
FIG. 2 illustrates a second embodiment of the invention, (a) of FIG. 2 being a perspective view a fuse unit according to the second embodiment before attaching a fuse box, and (b) of FIG. 2 being a schematic diagram of a fuse circuit using the fuse box according to the second embodiment.

FIG. 2 illustrates a second embodiment of the invention.

Figure 3:
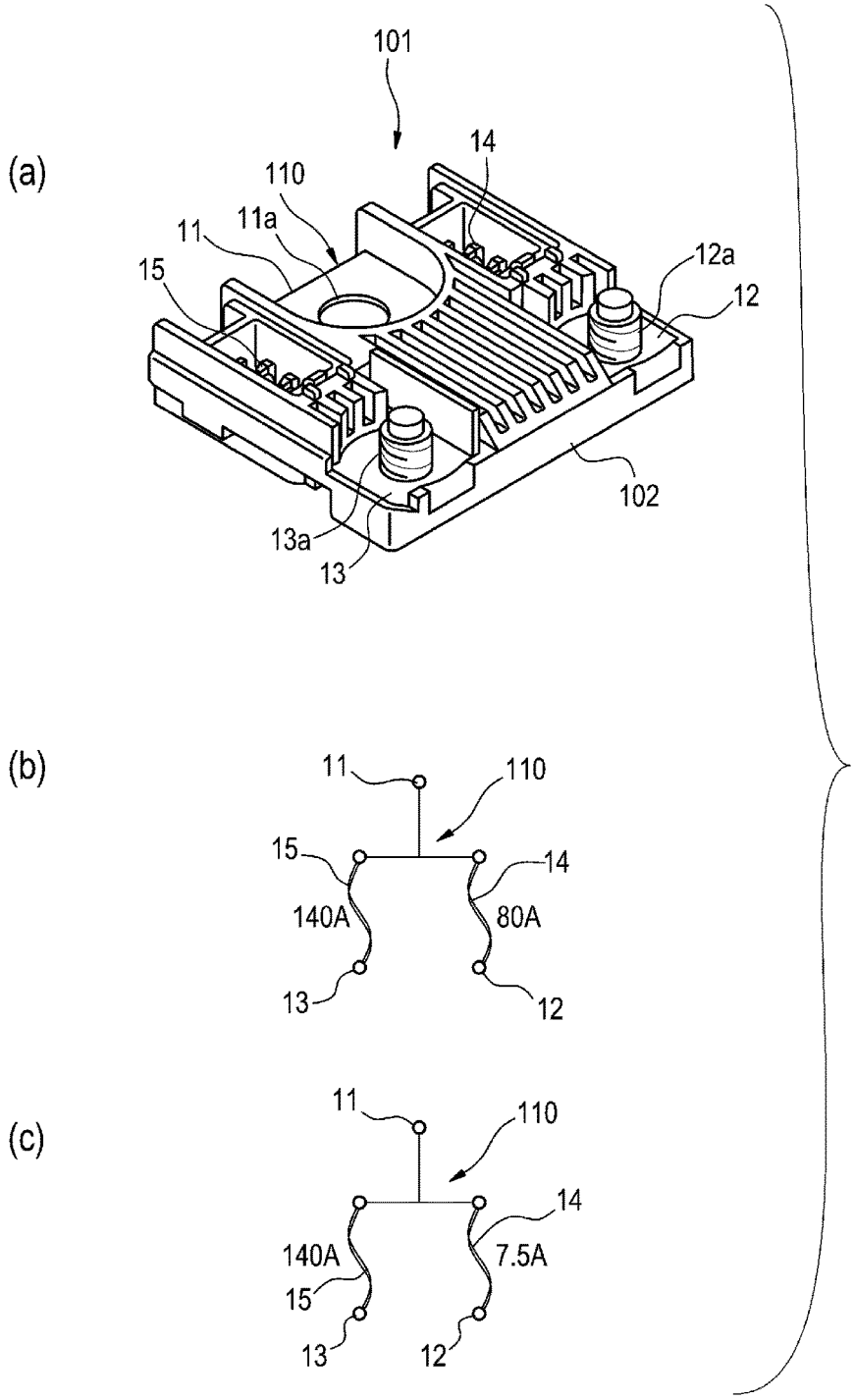
FIG. 3 illustrates a conventional fusible link, (a) of FIG. 3 being a perspective external view of the conventional fusible link, (b) of FIG. 3 being a schematic diagram of a fuse circuit formed by the same fusible link, and (c) of FIG. 3 being a schematic diagram of a fuse circuit having a combination of fusible elements that is difficult to achieve using the same fusible link.

In a fusible link according to the second embodiment, as shown in (a) of FIG. 2, the existing fusible link 101 shown in FIG. 3 is used as it is and is combined with a low-rated fuse box 20B.

The downstream terminals 12, 13 of the fusible link 101 are provided with the stud bolts 12*a*, 13*a* respectively, and a power-source-side terminal 26 of the low-rated fuse box 20B is configured so as to be connectable to one of the downstream terminals 12, 13. More specifically, the power-source-side terminal 26 of the low-rated fuse box 20B has a fitting hole 26*a* in which the stud bolt 12*a* (or 13*a*) is fitted and is configured as a plate terminal that is fastened to the downstream terminal 12 when a nut is threadedly engaged with the stud bolt 12*a*.

Also in the fuse unit according to the second embodiment, at the occurrence of a need for addition of a low-rated fuse line to the high-rated fusible link 101, the low-rated fuse box 20B is connected to the downstream terminal 12 of the high-rated fusible link 101 using the stud bolt 12*a*. In this manner, the low-rating load-side connection terminals 22 can easily be set downstream of the high-rating downstream terminal 12 of the fusible link 101. Thus, it is possible to promptly and flexibly accommodate a need for addition of a low-rated line.

Further, there is no problem of, for example, extra cost for a die because it is possible to accommodate a need for addition of a low-rated line using the existing fusible link 101 as it is. Still further, in the fuse unit according to the second embodiment, the power-source-side terminal 26 of the low-rated fuse box 20B is connected to the downstream terminal 12 of the fusible link 101, whereby the low-rated fuse box 20B can be connected to the fusible link 101 in a branched manner from the downstream terminal 12 connected to the upstream terminal 11 via the fusible element 14.

Moreover, the power-source-side terminal 26 of the low-rated fuse box 20B is fastened to the downstream terminal 12 of the fusible link 101 using the stud bolt 12*a*. Therefore, another load-side connection terminal (not shown) and the power-source-side terminal 26 of the low-rated fuse box 20B can be laid on each other and fastened together. Thus, the attachment of the low-rated fuse box 20B is facilitated.

The low-rated fuse box 20B may be attached to the other downstream terminal 13 of the fusible link 101. It is also possible to prepare another low-rated fuse box and attach the two low-rated fuse boxes to the respective downstream terminals 12, 13.

The invention is not limited to the above embodiments, and various changes and modifications may be made therein as appropriate. The material, shape, dimensions, number, location, etc. of each element in each embodiment are optional, and are not limited in so far as the present invention can be implemented.

The features of the fuse unit according to the embodiments of the present invention described above are briefly summarized in the following [1] to [5].

[1] A fuse unit including:

a fusible link (1, 101) having a high-rated terminal group and configured as a bulbar (10, 110) on which fusible elements (14, 15) defining rated values are integrally formed; and a low-rated fuse box (20, 20B) arranged downstream of the fusible link (1, 101) in a current flowing direction, the low-rated fuse box being connected to one terminal (18, 12, 13) of the terminal group of the fusible link (1, 101) in a detachable manner and having a lower rated value than the fusible link (1, 101), wherein the low-rated fuse box (20, 20B) includes a power-source-side terminal (21, 26) connected to the one terminal (auxiliary terminal 18, downstream terminal 12, downstream terminal 13) of the terminal group (upstream terminal 11, downstream terminal 12, downstream terminal 13, auxiliary terminal 18) of the fusible link (1, 101), at least one load-side connection terminal (22) to be connected to a load side, a holder (23) made of an insulating material and configured to hold the power-source-side terminal (21, 26) and the load-side connection terminal (22), and a low-current fuse (25) having a smaller rated current value than the fusible elements (14, 15) and configured to electrically connect, when attached to the holder (23) in a detachable manner, the power-source-side terminal (21, 26) and the load-side connection terminal (22) to each other.

[2] The fuse unit according to [1] described above, wherein the power-source-side terminal (21) of the low-rated fuse box (20) and the terminal (the auxiliary terminal 18) of the fusible link (1) to which the power-source-side terminal (21) is connected in a detachable manner are configured as a male terminal and a female terminal into which the male terminal is fitted.

[3] The fuse unit according to [1] described above, wherein the terminal (downstream terminal 12, downstream terminal 13) of the fusible link (101) to which the power-source-side terminal (26) of the low-rated fuse box (20B) is connected in a detachable manner has a stud bolt (12*a*, 13*a*), and the power-source-side terminal (26) of the low-rated fuse box (20B) has a fitting hole (26*a*) in which the stud bolt (12*a*, 13*a*9 is fitted and is configured as a plate terminal that is fastened to the terminal (downstream terminal 12, downstream terminal 13) when a nut is threadedly engaged with the stud bolt (12*a*, 13*a*).

The fuse unit according to any one of [1] to [3] described above, wherein the busbar (10) of the fusible link (1) has, as the terminal group, an upstream terminal (11) to be connected to a battery, downstream terminals (12, 13) connected to the upstream terminal (11) via the respective fusible elements (14, 15) and to be connected to a load side, and an auxiliary terminal (18) electrically connected to the upstream terminal (11) directly, wherein the auxiliary terminal (18) is configured as the terminal to which the power-source-side terminal (21) of the low-rated fuse box (20) is connected in a detachable manner.

[5] The fuse unit according to any one of the above items [1] to [3], wherein the busbar (10) of the fusible link (101) has, as the terminal group, an upstream terminal (11) to be connected to a battery and downstream terminals (12, 13) connected to the upstream terminal (11) via the respective fusible elements (14, 15) and to be connected to a load side, wherein one of the downstream terminals (12, 13) is configured as the terminal to which the power-source-side terminal (26) of the low-rated fuse box (20, 20B) is connected in a detachable manner.

The present application is based on Japanese Patent Application No. 2013-076061 filed on Apr. 1, 2013, the content of which is incorporated herein by reference.

INDUSTRIAL APPLICABILITY

Fuse units according to the present invention makes it possible to provide suitable fuse units that can flexibly accommodate, in particular, a need for an addition of a low-rated line without extra cost while using a high-rated fusible link.

DESCRIPTION OF REFERENCE SIGNS

1: Fusible link
10: Busbar
11: Upstream terminal (terminal group)
12, 13: Downstream terminal (terminal group)
14, 15: Fusible element
18: Auxiliary terminal (terminal group)
20, 20B: Low-rated fuse box
21: Power-source-side connection terminal
22: Load-side connection terminal
23: Holder
25: Low-current fuse
26: Power-source-side connection terminal
101: Fusible link
110: Busbar

The invention claimed is:

1. A fuse unit comprising:

a fusible link having a high-rated terminal group and configured as a busbar on which fusible elements defining rated values are integrally formed, the busbar includes a first terminal, a second terminal, a third terminal, and a fourth terminal, one of the fusible elements being electrically connected between the first terminal and the second terminal, another one of the fusible elements being electrically connected between the first terminal and the third terminal, the fourth terminal being electrically connected directly to the first terminal such that none of the fusible elements are electrically connected between the first terminal and the fourth terminal; and a low-rated fuse box arranged downstream of the fusible link in a current flowing direction, the low-rated fuse box being electrically connected to the fourth terminal of the terminal group of the fusible link in a detachable manner and having a lower rated value than the fusible link, wherein the low-rated fuse box comprises a power-source-side terminal electrically connected to the fourth terminal of the terminal group of the fusible link, at least one load-side connection terminal to be connected to a load side, a holder made of an insulating material and configured to hold the power-source-side terminal and the load-side connection terminal, and a low-current fuse having a smaller rated current value than the fusible elements and configured to electrically connect, when attached to the holder in a detachable manner, the power-source-side terminal and the load-side connection terminal to each other.

2. The fuse unit according to claim 1, wherein the power-source-side terminal of the low-rated fuse box and the terminal of the fusible link to which the power-source-side terminal is connected in a detachable manner are configured as a male terminal and a female terminal into which the male terminal is fitted.

3. The fuse unit according to claim 1, wherein the first terminal is an input terminal configured to be connected with a power source, and the second, third and fourth terminals are output terminals configured to be connected to a load such that electricity supplied by the power source flows from the first terminal to each of the second, third and fourth terminals if the power source is electrically connected to the first terminal.

* * * * *